US010573112B2

(12) United States Patent
Taniguchi et al.

(10) Patent No.: US 10,573,112 B2
(45) Date of Patent: Feb. 25, 2020

(54) COIN STORAGE DEVICE

(71) Applicant: FUJI ELECTRIC CO., LTD., Kawasaki-shi, Kanagawa (JP)

(72) Inventors: Yoshihiro Taniguchi, Yokkaichi (JP); Masashi Nagata, Yokkaichi (JP); Yoshiyuki Fukushima, Yokkaichi (JP); Takao Okuhara, Yokkaichi (JP)

(73) Assignee: FUJI ELECTRONICS CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 16/256,521

(22) Filed: Jan. 24, 2019

(65) Prior Publication Data

US 2019/0304230 A1 Oct. 3, 2019

(30) Foreign Application Priority Data

Mar. 28, 2018 (JP) ..... 2018-062568

(51) Int. Cl.

| | |
|---|---|
| ***G07D 3/12*** | (2006.01) |
| ***G07D 3/08*** | (2006.01) |
| ***G07D 9/00*** | (2006.01) |
| ***G07F 1/04*** | (2006.01) |
| ***G07F 9/06*** | (2006.01) |
| *G07F 5/24* | (2006.01) |

(52) U.S. Cl.

CPC ..... *G07D 3/08* (2013.01); *G07D 3/128* (2013.01); *G07D 9/002* (2013.01); *G07D 9/008* (2013.01); *G07F 1/047* (2013.01); *G07F 9/06* (2013.01); *G07F 5/24* (2013.01)

(58) Field of Classification Search

CPC ..... G07F 1/047; G07F 5/24; G07F 9/06

See application file for complete search history.

(56) References Cited

U.S. PATENT DOCUMENTS

2017/0098338 A1* 4/2017 Shibata ..... G07D 5/00
2017/0154486 A1 6/2017 Shibata et al.

FOREIGN PATENT DOCUMENTS

JP 2017-072948 A 4/2017

* cited by examiner

*Primary Examiner* — Mark J Beauchaine
(74) *Attorney, Agent, or Firm* — Manuba Kanesaka

(57) ABSTRACT

A coin storage device includes: storage compartments that store therein coins by denomination; and screw-type conveying members, installed for the respective storage compartments, each of the screw-type conveying members including a shaft having an elongated shape and having an outer circumferential surface provided with a blade portion that protrudes radially outwards in a spiraling shape, and conveying coins toward a front side by being rotated in one direction about a central axis of the shaft. Further, each of the screw-type conveying members includes an actuating portion to move center of gravity of coins accumulated on the actuating portion up and down periodically as the screw-type conveying member is rotated about the central axis of the shaft.

9 Claims, 19 Drawing Sheets

221
222
22
211
211
211
211
21a
211b
211b
21b
211
211
211
211

21a
211
211
211

COIN STORAGE DEVICE

CROSS-REFERENCE TO RELATED APPLICATION(S)

The present application claims priority to and incorporates by reference the entire contents of Japanese Patent Application No. 2018-062568 filed in Japan on Mar. 28, 2018.

BACKGROUND

The present disclosure relates to a coin storage device.

In the related art, a coin storage device has been disclosed in Japanese Laid-open Patent Publication No. 2017-72948. The coin storage device disclosed in Japanese Laid-open Patent Publication No. 2017-72948 includes storage compartments and screw-type conveying members.

The storage compartments are sections where the coins are stored by denomination. Each of the screw-type conveying members is installed correspondingly in the storage compartment, and includes a first screw element and a second screw element.

The first screw element includes a columnar first shaft portion the outer circumferential surface of which is provided with a first blade portion protruding radially outwards in a spiraling shape, and conveys coins to the front side by being rotated about the central axis of the first shaft portion.

The second screw element includes a columnar second shaft portion the outer circumferential surface of which is provided with a second blade portion protruding radially outwards in a spiraling shape, and conveys coins to the front side by being rotated about the central axis of the second shaft portion. The rear end of the second screw element is linked to the front end of the first screw element via a linking unit.

In such a coin storage device, each pitch formed by the second blade portion provided to the second screw element stores therein one coin having been conveyed by the first screw element, and, when a dispensing instruction is given, the second screw element is rotated, and dispenses the stored coin.

In the coin storage device described above, most of the coins stored in the storage compartment are accumulated on the screw-type conveying members (the first screw element). Therefore, if some of the coins are stored in an upright direction along one of the side walls of the storage compartment, a phenomenon, what may be called "bridging", may occur, in which the coins are accumulated so as to be bridged between the one side wall and the other side wall.

Once such bridging occurs, the blade portion (first blade portion) of the screw-type conveying member may be prevented from being brought into contact with the coins, even if the screw-type conveying member is rotated about the central axis of the shaft, and may cause the coins to jam in the storage compartment, and result in a failure to dispense the coins stored in the storage compartment.

SUMMARY

There is a need for providing a coin storage device capable of preventing jamming of coins in the storage compartments.

According to an embodiment, a coin storage device includes: storage compartments that store therein coins by denomination; and screw-type conveying members, installed for the respective storage compartments, each of the screw-type conveying members including a shaft having an elongated shape and having an outer circumferential surface provided with a blade portion that protrudes radially outwards in a spiraling shape, and conveying coins toward a front side by being rotated in one direction about a central axis of the shaft. Further, each of the screw-type conveying members includes an actuating portion to move center of gravity of coins accumulated on the actuating portion up and down periodically as the screw-type conveying member is rotated about the central axis of the shaft.

DETAILED DESCRIPTION

A coin storage device according to a preferred embodiment of the present disclosure will be described in detail with reference to the accompanied drawings.

Figure 1:
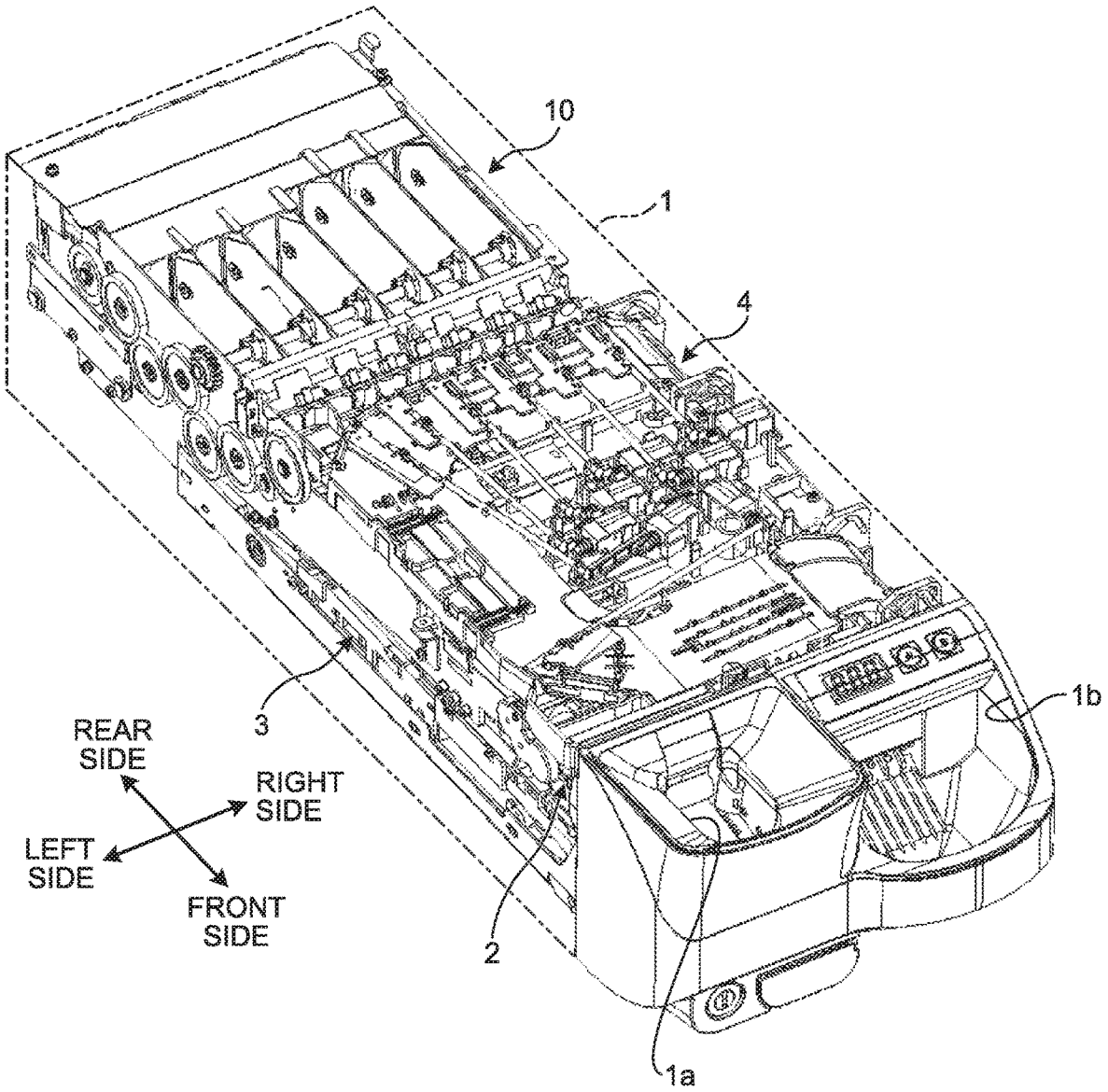
FIG. 1 is a perspective view illustrating an internal structure of a coin processor including a coin storage device according to an embodiment of the present disclosure.

FIG. 1 is a perspective view illustrating an internal structure of a coin processor including a coin storage device according to an embodiment of the present disclosure. A coin processing device 1, herein explained as an example, is used as a change dispensing machine in a store such as a supermarket or a convenience store, for example, and includes a coin separating device 2, a coin inspecting device 3, a coin conveying device 4, and a coin storage device 10.

The coin separating device 2 supplies the coins deposited through a money payment port 1*a* in a manner that the coins are separated one by one. The coin inspecting device 3 determines the authenticity and the denominations of the coins supplied from the coin separating device 2, and supplies authentic coins to the coin conveying device 4. The coin conveying device 4 conveys the coins (authentic coins) supplied from the coin inspecting device 3 along a conveying path, sorts the coins by denomination, and supplies the sorted coins to the coin storage device 10. The coin storage device 10 stores therein the coins by denomination, and dispenses coins into a money reception port 1*b* in response to a dispensing instruction.

Figure 2:
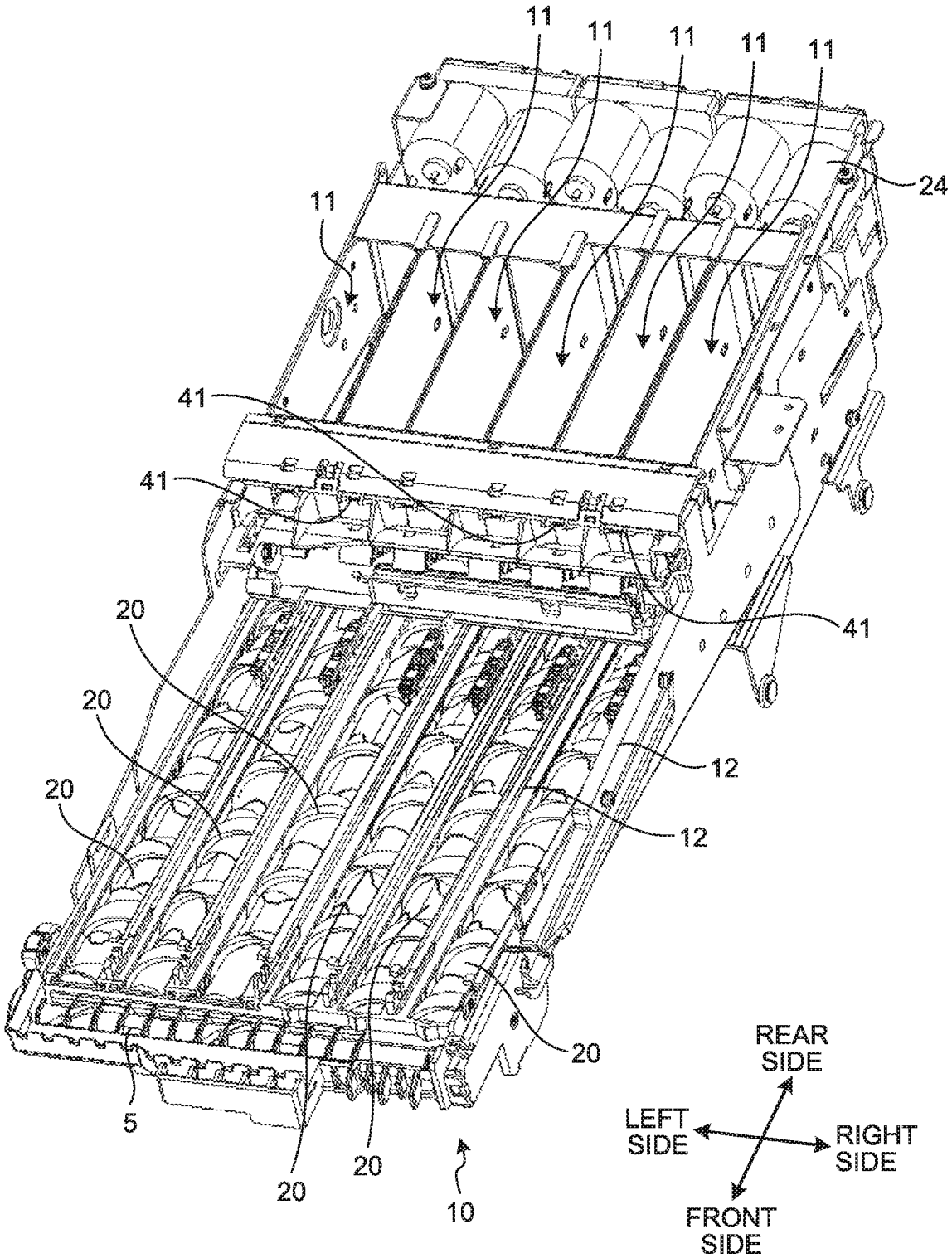
FIG. 2 is a perspective view illustrating the coin storage device of FIG. 1.
Figure 3:
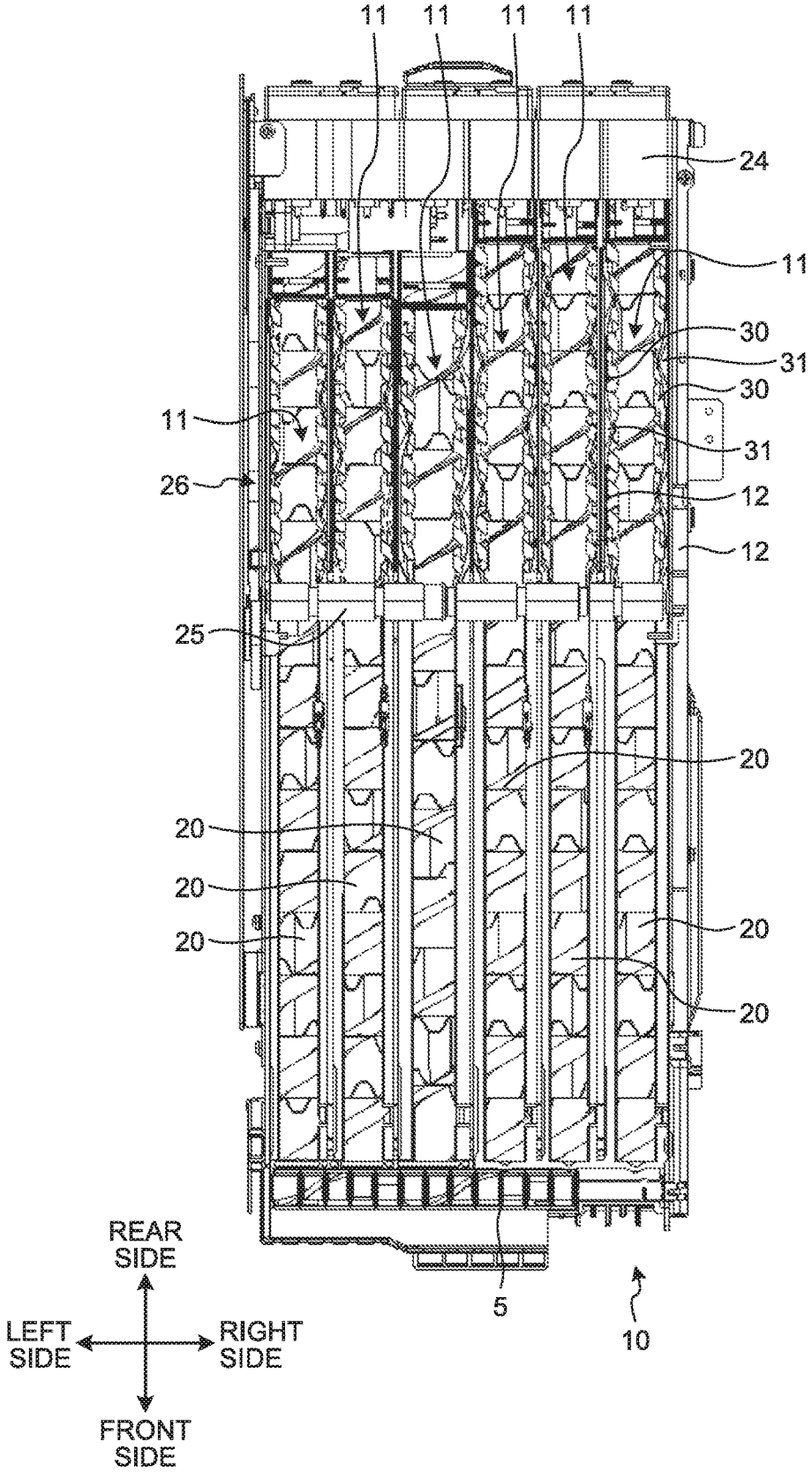
FIG. 3 is a plan view illustrating the main part of the coin storage device illustrated in FIG. 1.

The coin storage device 10 that is a characterizing part of the present disclosure will now be explained. Both FIGS. 2 and 3 illustrate the coin storage device 10 of FIG. 1. However, FIG. 2 is a perspective view, and FIG. 3 is a plan view illustrating a main part.

As illustrated in FIGS. 2 and 3, the coin storage device 10 has a structure in which a plurality of (for example, six, in the illustrated example) storage compartments 11 are arranged side by side. In other words, the coin storage device 10 has a structure in which the storage compartments 11 are provided for storing, for example, 50-yen coins, 5-yen coins, 500-yen coins, 100-yen coins, 1-yen coins, and 10-yen coins in a manner arranged in this order from the left side. All of the storage compartments 11 included in the coin storage device 10 have the same structure except their lengths in the left-to-right direction. Therefore, in the description below, the storage compartment 11 positioned on the rightmost side will be explained, and thus, the explanations of the other storage compartments 11 will be omitted.

Figure 4:
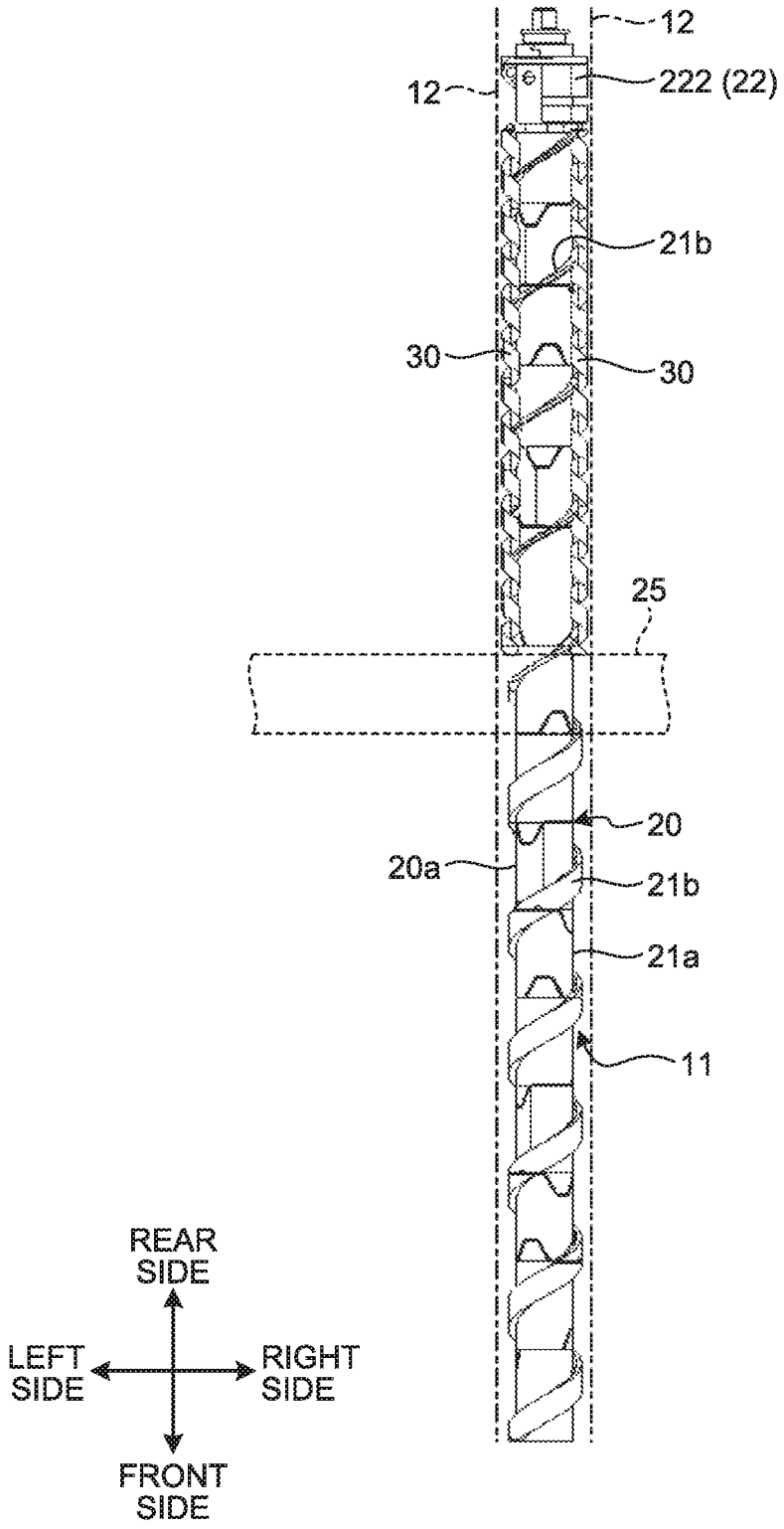
FIG. 4 is a plan view illustrating a main part of the storage compartment positioned on the rightmost side illustrated in FIGS. 2 and 3.

FIG. 4 is a plan view illustrating a main part of the storage compartment 11 of FIGS. 2 and 3 positioned on the rightmost side. As also illustrated in FIG. 4, the storage compartment 11 includes a screw-type conveying member 20 and a plurality of auxiliary screw members 30 all of which are disposed between a pair of left and right storage compartment guides 12.

Figure 5:
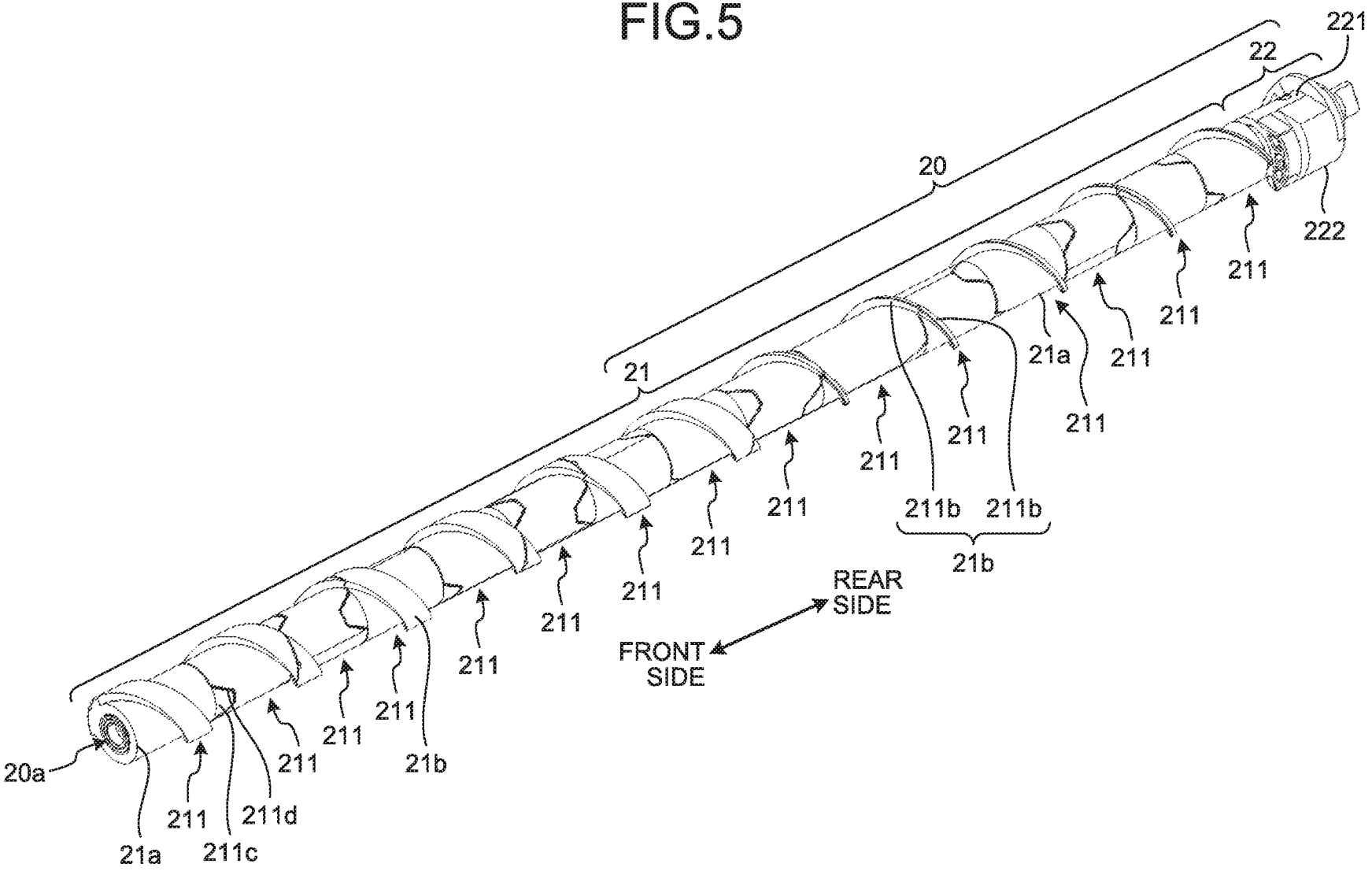
FIG. 5 is a perspective view illustrating a screw-type conveying member of FIG. 4.

As illustrated in FIG. 5, the screw-type conveying member 20 has an elongated shape with its longitudinal direction extending along the front-and-back direction, and includes a conveying portion 21 and a conveying base portion 22.

Figure 6:
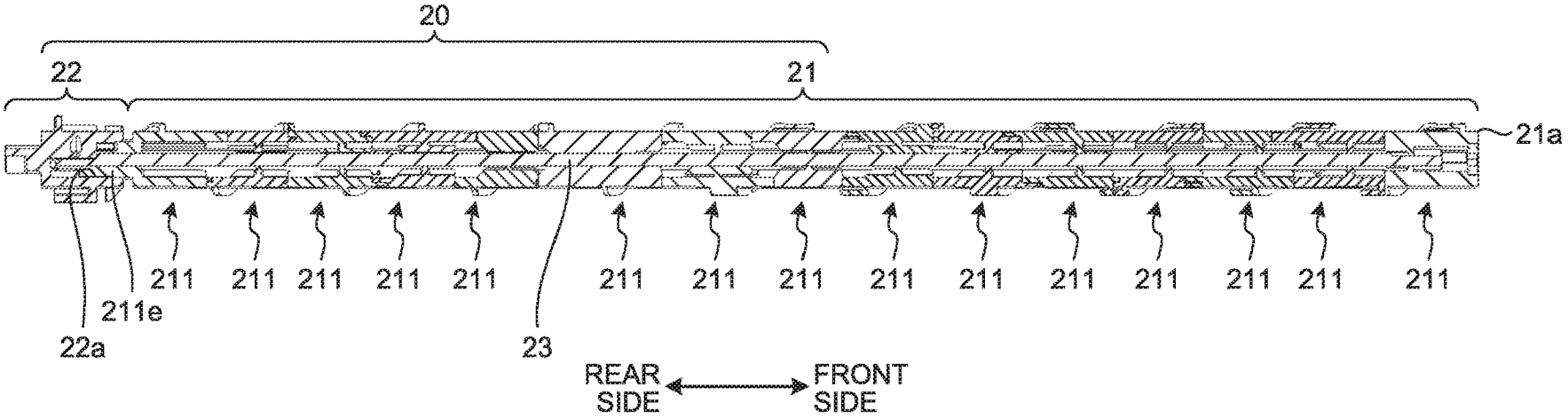
FIG. 6 is a vertical cross-sectional view of the screw-type conveying member of FIG. 5.

The conveying portion 21 includes a conveying shaft 21*a* that extends in the front-and-back direction, and the outer circumferential surface of which is provided with a blade portion 21*b* protruding radially outwards in a spiraling shape. Such a conveying portion 21 is formed by connecting a plurality of conveying elements 211. More specifically, the conveying portion 21 is formed by connecting the conveying elements 211 each of which has a size equal to or less than the pitch formed by the blade portion 21*b* when a core 23 is inserted into the conveying elements 211, as illustrated in FIG. 6, and the blade portion 21*b* is formed by connecting blade portion elements 211*b* that are provided to the conveying elements 211. The conveying elements 211 are connected to one another by inserting connecting protrusions 211*c* that are provided on one conveying element 211 into corresponding connecting recesses 211*d* provided on another conveying element 211.

The pitch, which is formed by the blade portion 21*b*, is a pitch formed by the adjacent blade portions 21*b*, viewing the screw-type conveying member 20 from one direction, e.g., from above, and is set to a size preventing a plurality of coins to fit inside.

Figure 7:
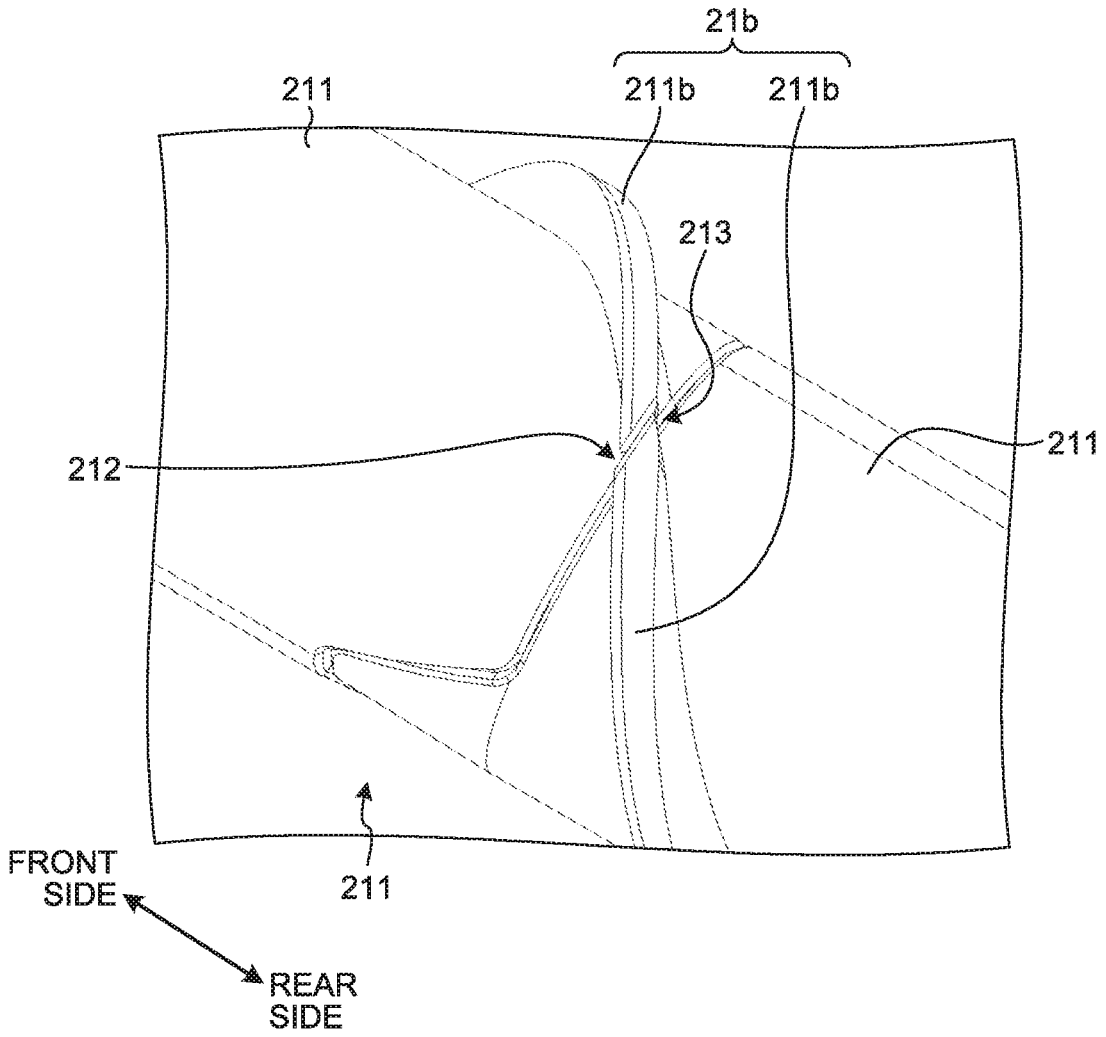
FIG. 7 is an enlarged perspective view illustrating a main part of the screw-type conveying member of FIG. 5.

In the conveying portion 21, in a border part between one blade portion element 211*b* and another blade portion element 211*b* together forming the blade portion 21*b*, a front side stepped portion 212 is formed in such a manner that the front surface of the blade portion element 211*b* positioned on the rear side protrudes toward the front side with respect to the front surface of the blade portion element 211*b* positioned on the front side, as illustrated in FIG. 7. Furthermore, a rear side stepped portion 213 is formed in such a manner that the rear surface of the blade portion element 211*b* positioned on the front side protrudes further toward the rear side with respect to the rear surface of the blade portion element 211*b* positioned on the rear side.

Figure 8:
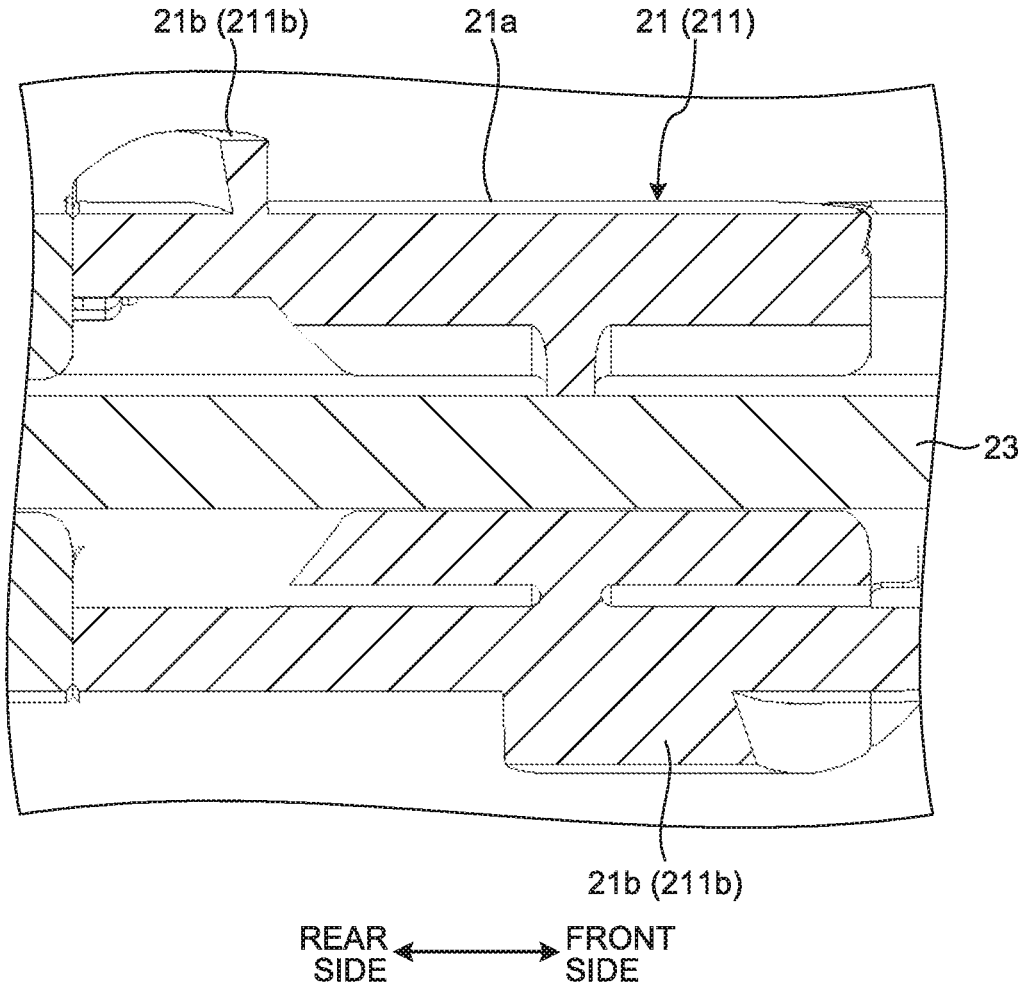
FIG. 8 is an enlarged vertical cross-sectional view illustrating a main part of the screw-type conveying member of FIG. 5.

In the conveying portion 21, as illustrated in FIG. 8, the blade portion 21*b* (blade portion element 211*b*) has a cross-sectional shape in which the width in the front-and-back direction becomes greater as the positions separate from the conveying shaft 21*a*.

The conveying base portion 22 is provided on the rear end side of the conveying portion 21. The core 23 serving as the central axis of the conveying portion 21 is inserted into the conveying base portion 22, and an engaging projection 211*e* of the conveying element 211 positioned on the rearmost end is inserted into and engaged with an engaging recess 22*a* of the conveying base portion 22, so that the conveying base portion 22 is engaged with the conveying portion 21 and the screw-type conveying member 20 is formed thereby. In other words, the conveying base portion 22 can be integrally rotated with the conveying portion 21, about the core 23 as a common central axis that is shared between the conveying base portion 22 and the conveying portion 21.

Figure 9:
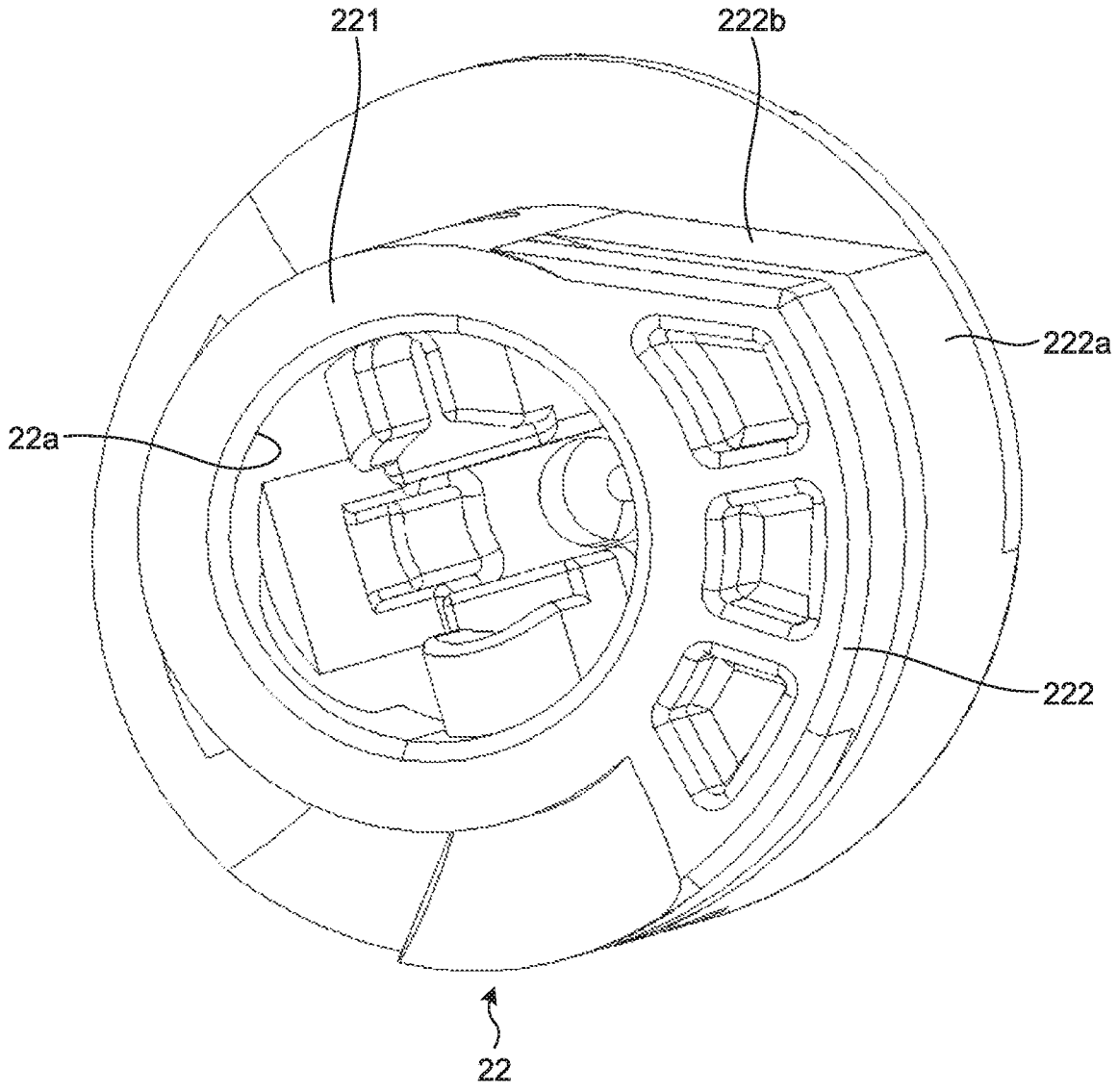
FIG. 9 is a perspective view illustrating a conveying base portion of FIG. 5.

Such a conveying base portion 22 includes a base end shaft 221 and an actuating portion 222, as illustrated in FIG. 9. The base end shaft 221 is a part that serves as the shaft 20*a* of the screw-type conveying member 20 together with the conveying shaft 21*a* of the conveying portion 21, in a configuration in which the conveying base portion 22 is engaged with the conveying portion 21, and extends along the front-and-back direction. This base end shaft 221 has the same outer diameter as that of the conveying shaft 21*a*.

Figure 10:
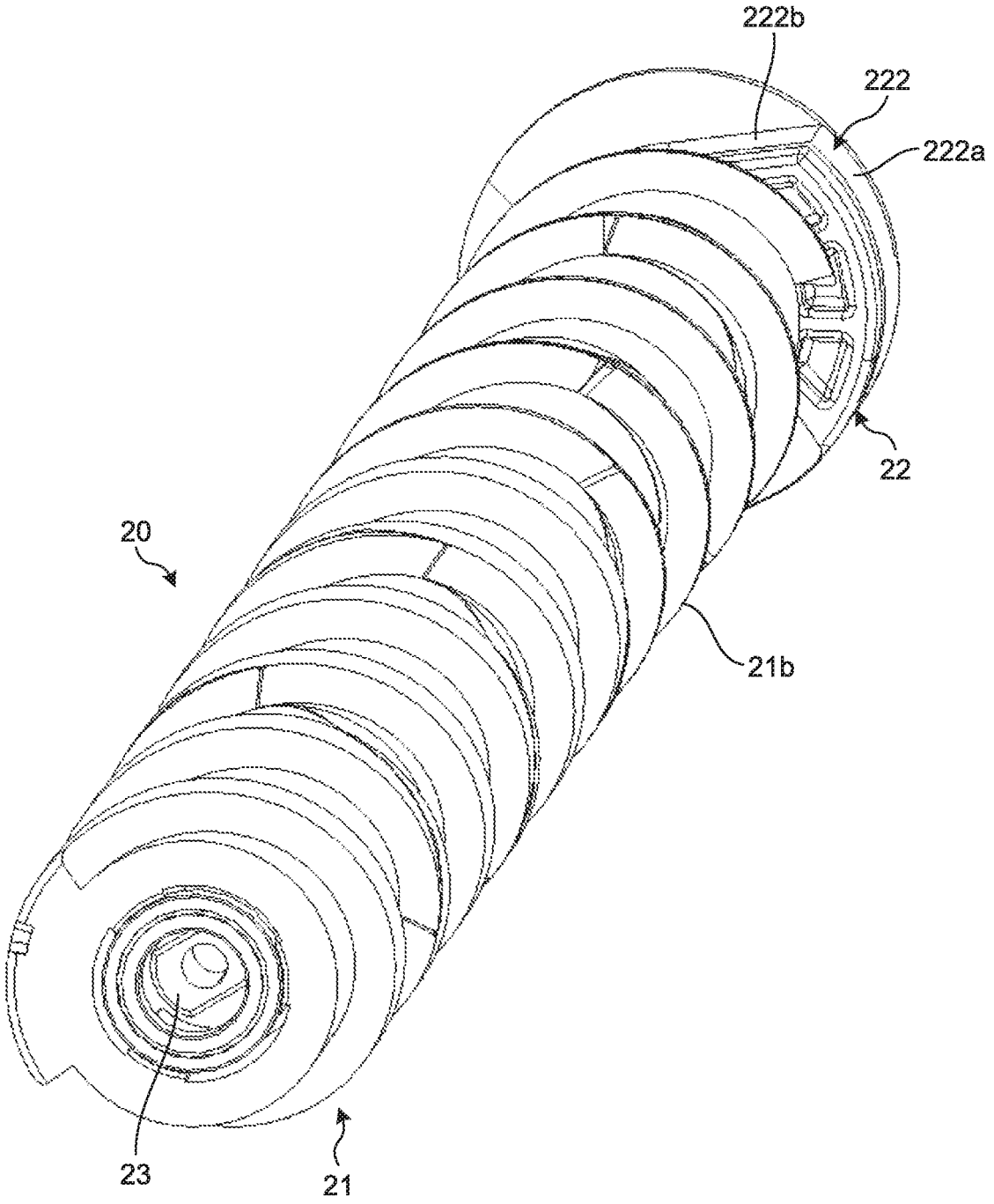
FIG. 10 is a perspective view illustrating the screw-type conveying member of FIG. 4.

The actuating portion 222 is provided on the outer circumferential surface of the base end shaft 221, in a manner protruding radially in directions orthogonal to the longitudinal direction (front-and-back direction) of the base end shaft 221. This actuating portion 222 includes an actuating outer circumferential surface 222*a*, positioned radially more outwards than the blade portion 21*b*, and an actuating surface 222*b*, that is planar and is continuous to the actuating outer circumferential surface 222*a*, as illustrated in FIG. 10 as well. This actuating surface 222*b* is a plane including a line tangent to the base end shaft 221 (shaft 20*a*).

In the screw-type conveying member 20 including an engagement of the conveying portion 21 and the conveying base portion 22, the conveying base portion 22 that is the rear end is connected to a motor 24 via a connecting unit (not illustrated). The motor 24 is driven in response to an instruction given by a storage control unit 50, which will be described later, and is enabled to rotate forwardly and reversely. When the motor 24 is driven forwardly, the screw-type conveying member 20 is rotated in one direction (e.g., in the counterclockwise direction in a view from the rear side) about the central axis of the shaft 20*a* (the conveying shaft 21*a* and the base end shaft 221), and conveys the coins toward the front side. When the motor 24 is driven reversely, the screw-type conveying member 20 is rotated in the other direction about the central axis of the shaft 20*a* (e.g., in the clockwise direction in the view from the rear side), and conveys the coins toward the rear side.

Such a screw-type conveying member 20 stores therein coins in a stacked manner, in a rear end section that is behind a reverse roller 25 (see FIGS. 3 and 4), but stores one coin in each of the pitches formed by the blade portion 21*b*, in a front end section that is in front of the reverse roller 25.

The reverse roller 25 extends along the left-and-right direction in a manner extending over the storage compartments 11, and is rotatable about the central axis thereof. Such a reverse roller 25 is linked to the motor 24 via a linking unit 26 (see FIG. 3), and is caused to rotate by being driven by the motor 24. When the reverse roller 25 is rotated about the central axis, the reverse roller 25 is brought into contact with the coins being carried by the screw-type conveying member 20 toward the front side, so that the coins are stored in the respective pitches formed by the blade portion 21*b*.

Figure 11:
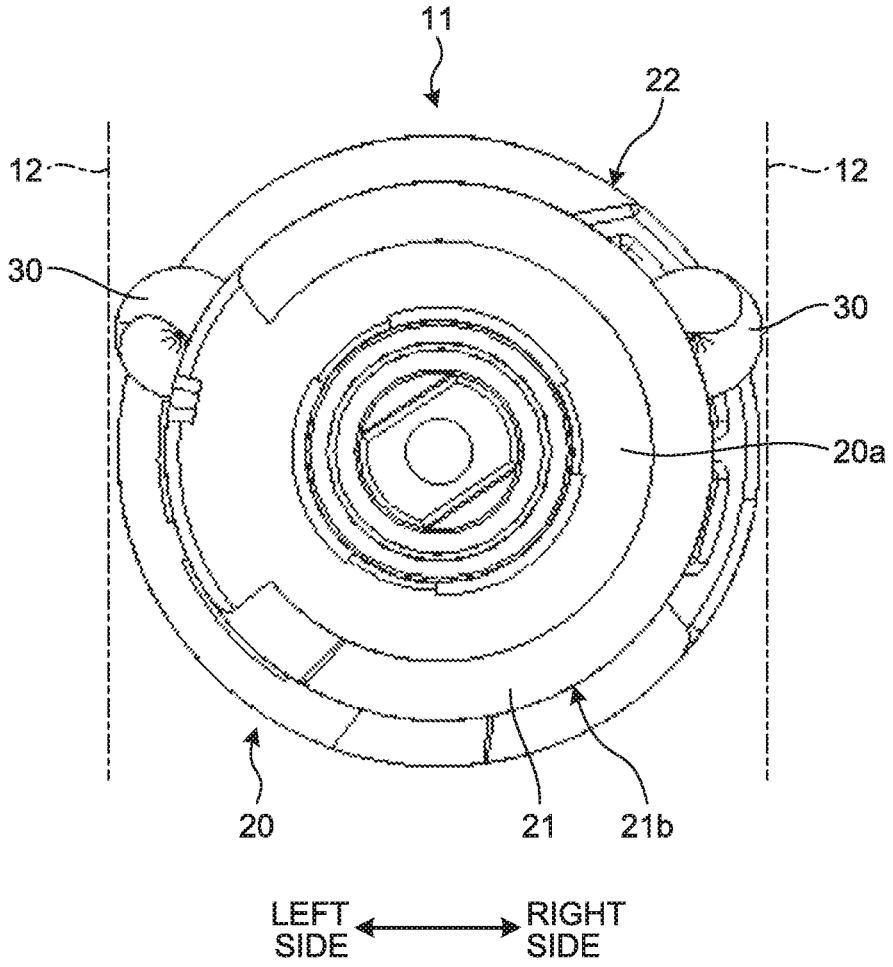
FIG. 11 is a front view illustrating a main part of the storage compartment of FIG. 4.

As illustrated in FIG. 4, the auxiliary screw members 30 are provided in the rear end section that is behind the reverse roller 25, as a pair on the left and the right sides, in the left and the right space of the corresponding screw-type conveying member 20. These auxiliary screw members 30 are wound in a spiral shape, and, as illustrated in FIG. 11, are meshed with the blade portion 21*b*, with the central axes thereof positioned at a level higher than the central axis of the screw-type conveying member 20.

Such auxiliary screw members 30 are rotated about the respective central axes, when the screw-type conveying member 20 is rotated about the central axis of the shaft 20*a*, by being driven by the rotation of the screw-type conveying member 20.

Figure 12:
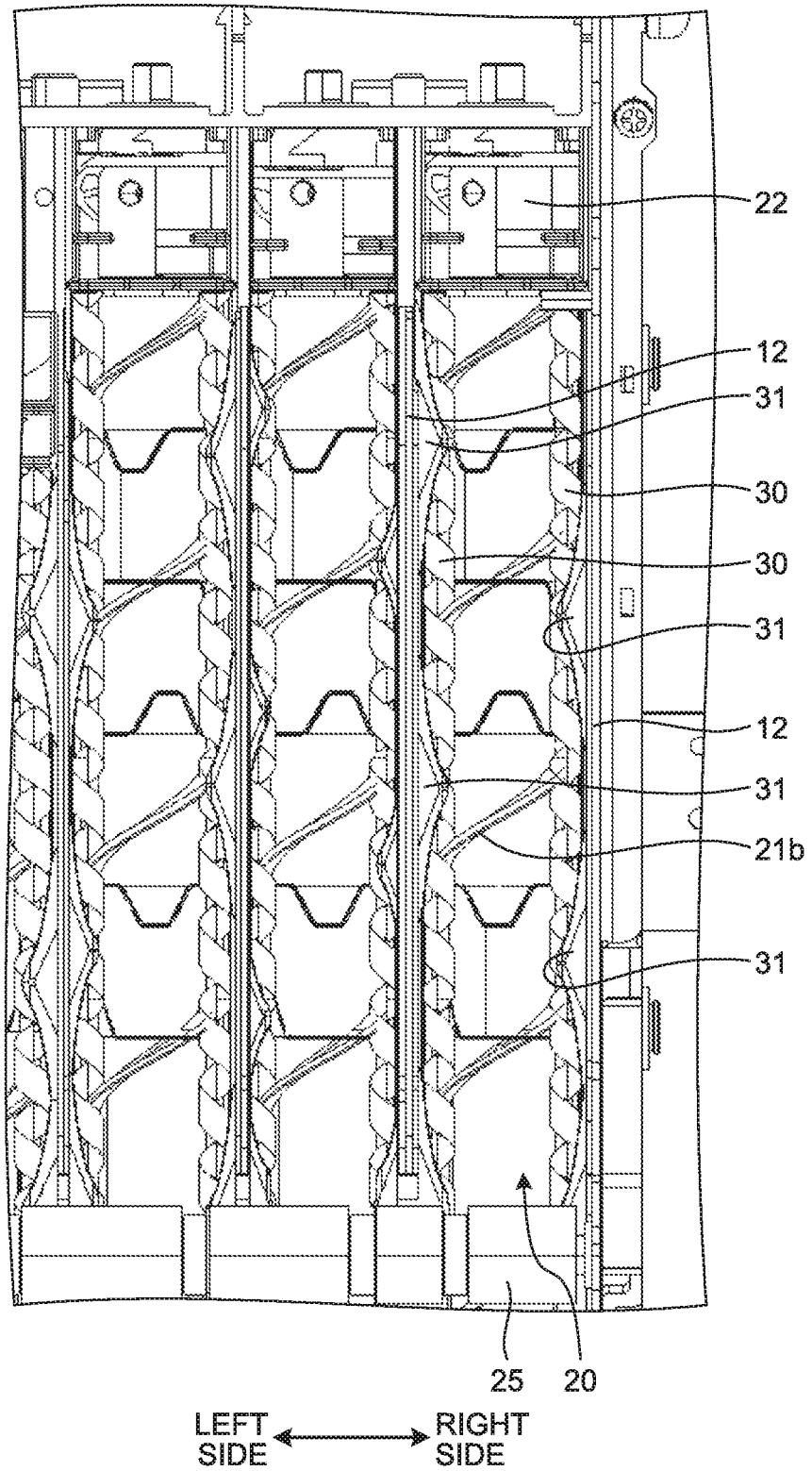
FIG. 12 is an enlarged plan view illustrating a main part of the coin storage device of FIG. 3.

Restricting guides 31 are provided on an upper area of the auxiliary screw members 30. The restricting guides 31 are provided in a manner protruding from the corresponding storage compartment guide 12 toward the screw-type conveying member 20, as illustrated in FIG. 12, and restricts upward movements of the auxiliary screw members 30 so as to prevent the auxiliary screw members 30 from becoming unmeshed from the screw-type conveying member 20.

Such restricting guides 31 are disposed in the manner described below. Specifically, the restricting guides 31 for the left auxiliary screw member 30 are disposed at positions facing where the restricting guides 31 for the right auxiliary screw member 30 are not provided, and the restricting guides 31 for the right auxiliary screw member 30 are disposed at positions facing where the restricting guides 31 for the left auxiliary screw member 30 are not provided. In other words, the restricting guides 31 for one of the auxiliary screw members 30 are disposed at positions facing where the restricting guides 31 for the other auxiliary screw member 30 are not provided.

Figure 13:
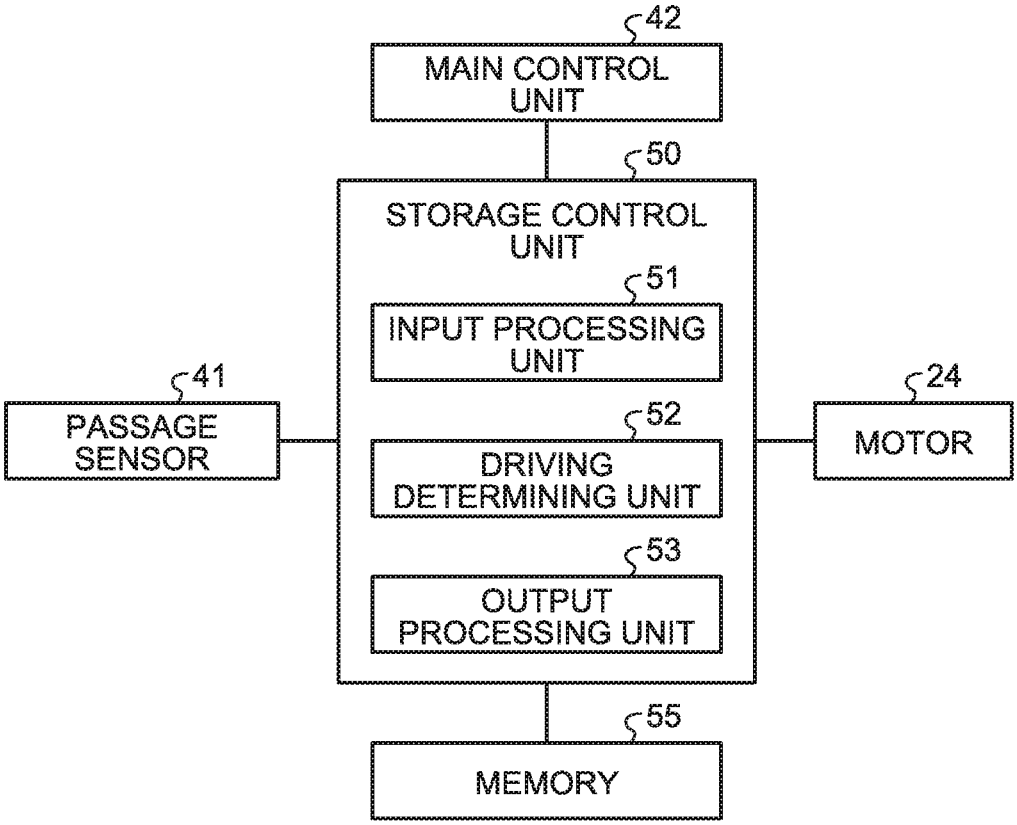
FIG. 13 is a schematic diagram illustrating a control system characterizing the coin storage device according to an embodiment of the present disclosure.

FIG. 13 is a schematic diagram illustrating a control system including the coin storage device 10 according to an embodiment of the present disclosure. As illustrated in FIG. 13, the coin storage device 10 includes, besides the components described above, passage sensors 41 and a storage control unit (control unit) 50.

The passage sensors 41 are formed by optical sensors, for example, and are provided with the respective storage compartments 11, as illustrated in FIG. 2. Each of the passage sensors 41 detects the coins supplied from the coin conveying device 4 into the corresponding storage compartment 11, and the detection result is sent to the storage control unit 50, as a passage signal.

The storage control unit 50 comprehensively controls the operations of the coin storage device 10, based on a computer program and data stored in a memory 55, and includes an input processing unit 51, a driving determining unit 52, and an output processing unit 53.

The storage control unit 50 may be implemented by causing a processor such as a Central Processing Unit (CPU) to execute a computer program, that is, by software, implemented by hardware such as an Integrated Circuit (IC), or may be implemented as a combination of software and hardware. This storage control unit 50 controls each of the storage compartments 11 individually.

The input processing unit 51 receives an input of a passage signal given from the passage sensors 41. The input processing unit 51 also receives an input of an instruction (such as a dispensing instruction or a stop instruction) given by a main control unit 42 comprehensively controlling the operations of the coin processing device 1.

The driving determining unit 52 determines whether a reverse driving condition is satisfied, when a passage signal is received via the input processing unit 51. The reverse driving condition is stored in the memory 55, and specifies whether the number of coins stored in the storage compartment 11 is equal to or greater than a predetermined number (threshold). In other words, the driving determining unit 52 adds the number of coins remaining in the storage compartment 11 since when the coins are dispensed last time, to the number of coins supplied into the storage compartment 11, and determines that the reverse driving condition is satisfied if the resultant sum is equal to or greater than the threshold.

The output processing unit 53 controls driving and the like the motor 24, by outputting a driving instruction (a forward driving instruction or a reverse driving instruction) and a driving stop instruction (a forward driving stop instruction or a reverse driving stop instruction) to the motor 24.

In the coin storage device 10 having such a structure, when the storage control unit 50 receives an input of a dispensing instruction given by the main control unit 42 via the input processing unit 51, the storage control unit 50 sends a forward driving instruction to the motor 24 via the output processing unit 53. This causes the screw-type conveying member 20 to rotate in one direction (e.g., in the counterclockwise direction in a view from the rear side) about the central axis of the shaft 20*a* (the conveying shaft 21*a* and the base end shaft 221). As a result, in the front end section of the screw-type conveying member 20, a predetermined number of coins, stored in the corresponding pitch formed by the blade portion 21*b*, are conveyed toward the front side, and dispensed into a dispensed coin conveyor 5 (see FIGS. 2 and 3). As a result, the coins are dispensed from the dispensed coin conveyor 5 into the money reception port 1*b*. By driving the motor 24 in the forward direction in the manner described above, some of the coins accumulated in the rear end section of the screw-type conveying member 20 are conveyed toward the front side, and are stored as preparatory money in the front end section of the screw-type conveying member 20 by the operation of the reverse roller 25, with each of such coins stored in the corresponding pitch formed by the blade portion 21*b*.

In the coin processing device 1, when a plurality of coins are deposited via the money payment port 1*a*, the coin separating device 2 separates the coins one by one, and the coin inspecting device 3 differentiates the coins supplied from the coin separating device 2 based on the authenticity and the denominations of the coins, and supplies the authentic coins into the coin conveying device 4. The coin conveying device 4 then conveys the coins supplied from the coin inspecting device 3 (the authentic coins) along the conveying path, classifies the coins by denomination, and supplies the classified coins into the coin storage device 10. As a result, the storage control unit 50 executes a screw conveying control process as described below.

Figure 14:
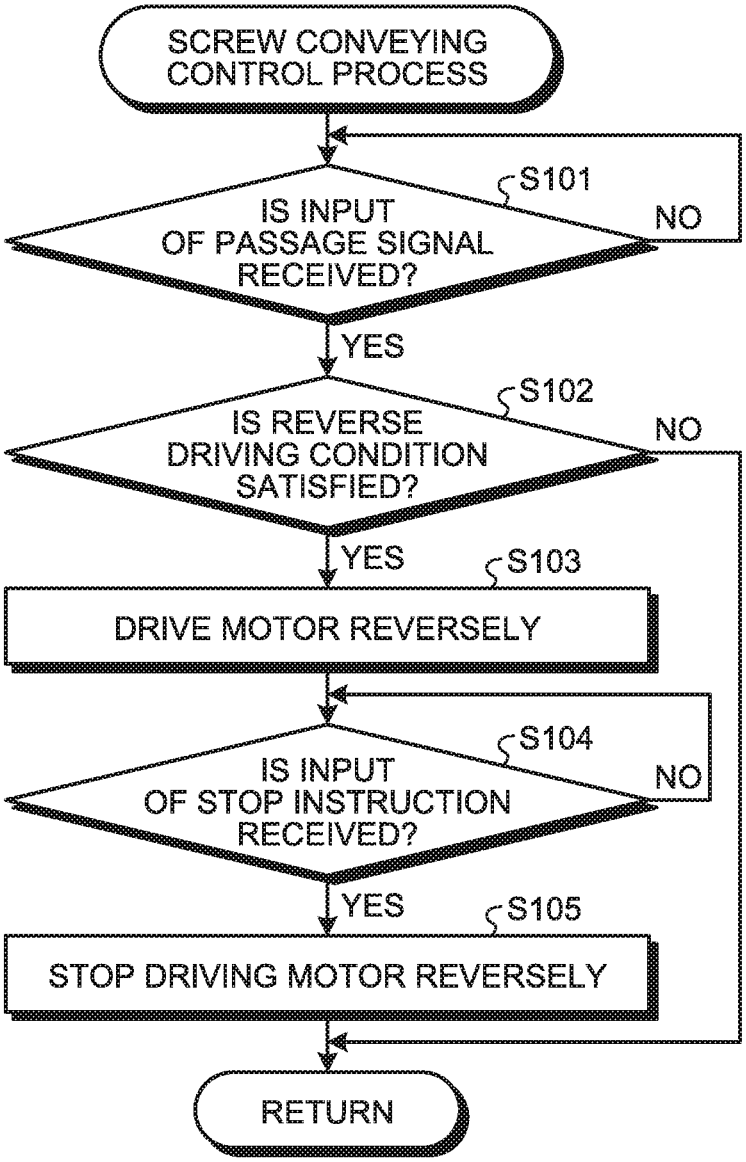
FIG. 14 is a flowchart illustrating of a screw conveying control process executed by a storage control unit of FIG. 13.

FIG. 14 is a flowchart illustrating the screw conveying control process performed by the storage control unit 50 of FIG. 13.

In the screw conveying control process, if a passage signal is input via the input processing unit 51 (Yes in Step S101), the storage control unit 50 causes the driving determining unit 52 to determine whether a reverse driving condition is satisfied (Step S102). In other words, the storage control unit 50 causes the driving determining unit 52 to add the number of coins remaining in the storage compartment 11 since when the coins are disposed last time to the number of supplied coins, and to determine whether the resultant sum is equal to or greater than the threshold.

If it is determined that the reverse driving condition is not satisfied (No in Step S102), the process goes back to the beginning without performing the process described below, and ends. In this case, more coins can be supplied into and stored in the rear end section of the screw-type conveying member 20.

If it is determined that the reverse driving condition is satisfied (Yes in Step S102), the storage control unit 50 sends a reverse driving instruction to the motor 24 via the output processing unit 53, and drives the motor 24 reversely (Step S103).

In response, the screw-type conveying member 20 is rotated in the other direction about the central axis of the shaft 20*a* (e.g., in the clockwise direction in the view from the rear side), and conveys the coins toward the rear side. In this manner, because the screw-type conveying member 20 is rotated in the other direction about the central axis of the shaft 20*a,* the coins accumulated in the rear end section of the screw-type conveying member 20 are also conveyed to the rear side.

Because the conveying base portion 22 that is the rear end of the screw-type conveying member 20 has the actuating portion 222 that includes the actuating outer circumferential surface 222*a,* positioned radially more outwards than the blade portion 21*b,* and the actuating surface 222*b,* that is a plane continuous to the actuating outer circumferential surface 222*a* and including a line tangent to the base end shaft 221 (shaft 20*a*), so that the actuating surface 222*b* and the actuating outer circumferential surface 222*a* are brought into contact with the coins alternatingly. In this manner, the actuating portion 222 can move the center of gravity of the coins accumulated on the actuating portion 222 up and down periodically.

Figure 15:
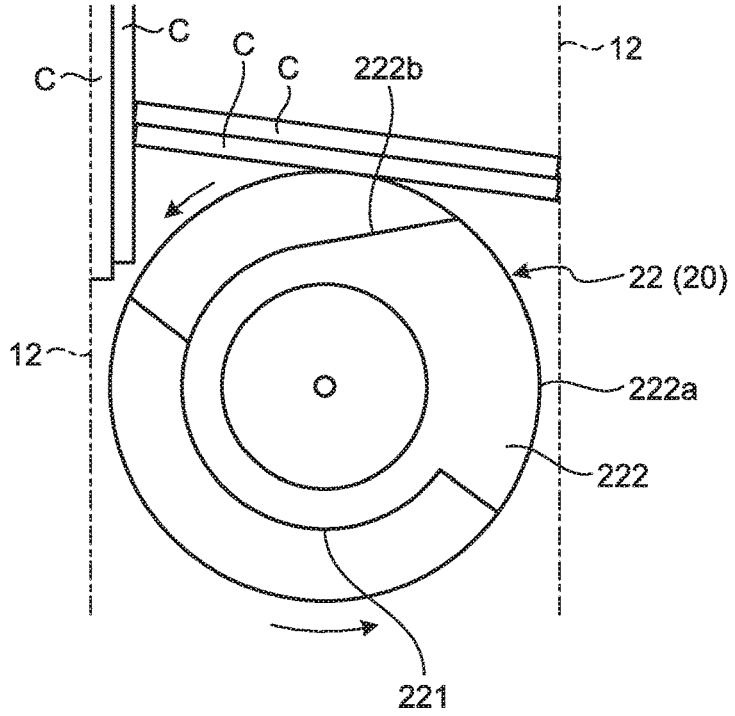
FIG. 15 is a view illustrating an operation of the conveying base portion provided to a rear end section of the screw-type conveying member.
Figure 16:
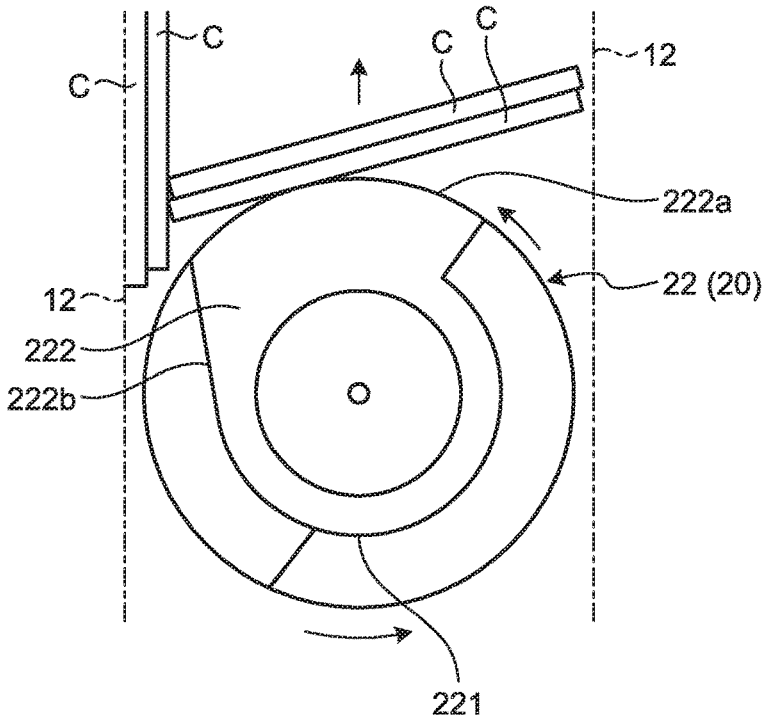
FIG. 16 is another view illustrating the operation of the conveying base portion provided to the rear end section of the screw-type conveying member.

In particular, even if some of the coins C become stored in the upright direction along the left storage compartment guide 12, and a phenomenon what is called "bridging" occurs, in which the coins C are accumulated so as to be bridged between the right and the left storage compartment guides 12 as illustrated in FIGS. 15 and 16, such bridging can be resolved by causing the actuating portion 222 to move the center of gravity of the coins C accumulated on the actuating portion 222 up and down periodically.

If the storage control unit 50 then inputs a stop instruction given by the main control unit 42 via the input processing unit 51 (Yes in Step S104), the storage control unit 50 sends a reverse driving stop instruction to the motor 24 via the output processing unit 53, and stops driving the motor 24 reversely (Step S105). Then, the process goes back to the beginning, and ends.

Through the process, the coins accumulated in the rear end section of the screw-type conveying member 20 inside of the storage compartment 11 can be evenly distributed across the entire rear end section, and it is possible to prevent the coins from being gathered on the front end side of the rear end section.

As explained above, with the coin storage device 10 according to the embodiment of the present disclosure, when the screw-type conveying member 20 is rotated in the other direction about the central axis of the shaft 20*a,* the actuating portion 222 provided to the rear end of the screw-type conveying member 20 moves the center of gravity of the coins accumulated on the actuating portion 222 up and down periodically. Therefore, what is called "bridging" can be eliminated, so that it is possible to prevent jamming of the coins in the storage compartment 11.

According to the coin storage device 10 described above, when the screw-type conveying member 20 is rotated about the central axis of the shaft 20*a,* the auxiliary screw members 30, meshed with the blade portion 21*b,* are caused to rotate about their respective central axes, by being driven by the rotation of the screw-type conveying member 20, in the space on the respective left and right sides of the rear end section of the screw-type conveying member 20 of the storage compartment 11. Therefore, it is possible to prevent the coin from being stuck between the screw-type conveying member 20 and each of the pair of the left and right storage compartment guides 12 that constitute the storage compartment 11. Hence, it is possible to prevent jamming of the coins in the storage compartment 11.

According to the coin storage device 10 described above, because the restricting guides 31 are provided for preventing the auxiliary screw members 30 from being unmeshed from the screw-type conveying member 20, and the restricting guides 31 for one of the auxiliary screw members 30 are disposed at positions facing where the restricting guides 31 for the other auxiliary screw member 30 are not provided, it is possible to prevent the coins from being positioned in a manner bridged between the restricting guide 31 for the one auxiliary screw member 30 and the other restricting guide 31 for the other auxiliary screw member 30. In this manner, the coins can be conveyed by rotating the screw-type conveying member 20, and this configuration also serves to prevent jamming of the coins in the storage compartment 11.

According to the coin storage device 10 described above, the conveying portion 21 of the screw-type conveying member 20 includes a plurality of conveying elements 211 that are connected to one another. Therefore, it is possible to use a highly rigid material for the conveying elements 211, to which a heavy load is applied, and use another material for the other conveying elements 211. In other words, for example, it is possible to use a metal material for the conveying elements 211 positioned below the reverse roller 25, and to use a resin material for the other conveying elements 211. In this manner, the weight of the screw-type conveying member 20 can be reduced, compared with a configuration in which the entire screw-type conveying member is made of a metal material.

Moreover, in the conveying portion 21, in a border part between the blade portion element 211*b* and the blade portion element 211*b* together forming the blade portion 21*b,* the front side stepped portion 212 is formed in such a manner that the front surface of the blade portion element 211*b* positioned on the rear side protrudes toward the front side with respect to the front surface of the blade portion element 211*b* positioned on the front side. Therefore, when the screw-type conveying member 20 is rotated about the central axis of the shaft 20*a* in one direction, it is possible to prevent the coin from being caught at the border part, and thus, the coins can be conveyed smoothly toward the front side. Furthermore, because the rear side stepped portion 213 is formed in such a manner that the rear surface of the blade portion element 211*b* positioned on the front side protrudes further toward the rear side with respect to the rear surface of the blade portion element 211*b* positioned on the rear side. Therefore, when the screw-type conveying member 20 is rotated about the central axis of the shaft 20*a* in the other direction, it is possible to coins being caught at the border part, and the coins can be conveyed smoothly toward the rear side.

Furthermore, in the conveying portion 21, the blade portion 21*b* (the blade portion element 211*b*) has a cross-sectional shape in which the width in the front-and-back direction becomes greater toward the tip positioned as the position of the width is separated from the conveying shaft 21*a*. Therefore, when the screw-type conveying member 20 is rotated about the central axis of the shaft 20*a* in one direction, the tip of the blade portion 21*b* and the entire surface of a part above the conveying shaft 21*a* can be brought into contact with the coin. Therefore, the coin can be conveyed smoothly.

Figure 17:
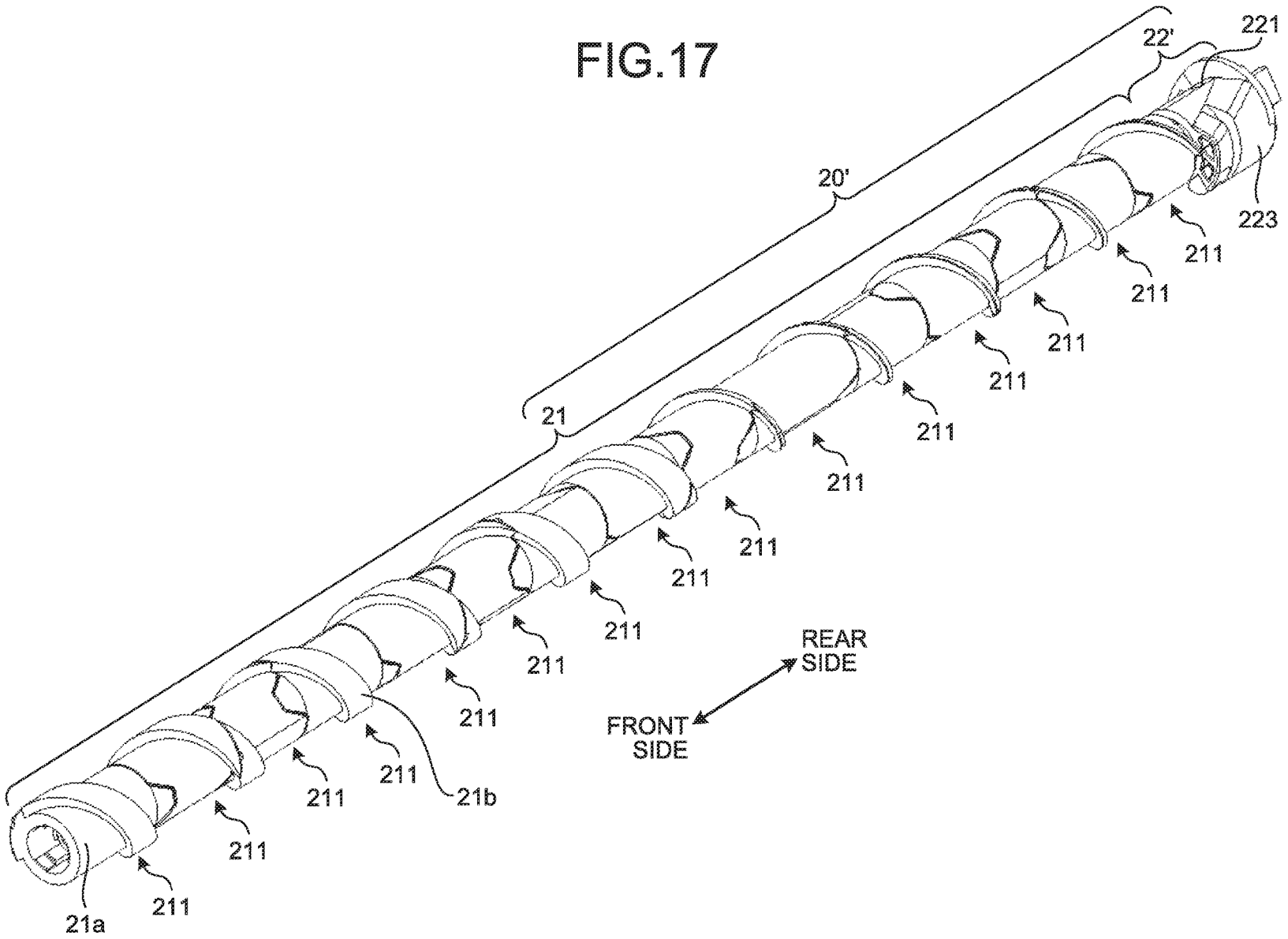
FIG. 17 is a perspective view illustrating a modified example of the screw-type conveying member of FIG. 5.

FIG. 17 is a perspective view illustrating a modified example of the screw-type conveying member 20 of FIG. 5. The elements that are the same as those in the screw-type conveying member 20 described above are given the same reference numerals, and explanations thereof will be omitted as appropriate.

A screw-type conveying member 20' explained herein as the modified example has an elongated shape with its longitudinal direction extending along the front-and-back direction, and includes the conveying portion 21 and a conveying base portion 22'.

The conveying base portion 22' is provided on the rear end side of the conveying portion 21. The conveying base portion 22' is inserted in the core 23 serving as the central axis of the conveying portion 21, and the engaging projection 211*e* of the conveying element 211 positioned on the rearmost end is inserted into and engaged with the engaging recess 22*a* of the conveying base portion 22', so that the conveying base portion 22' is engaged with the conveying portion 21, and the screw-type conveying member 20' is constituted thereby. In other words, the conveying base portion 22' can be rotated integrally with the conveying portion 21 about the core 23 as a common central axis that is shared between the conveying base portion 22' and the conveying portion 21.

Figure 18:
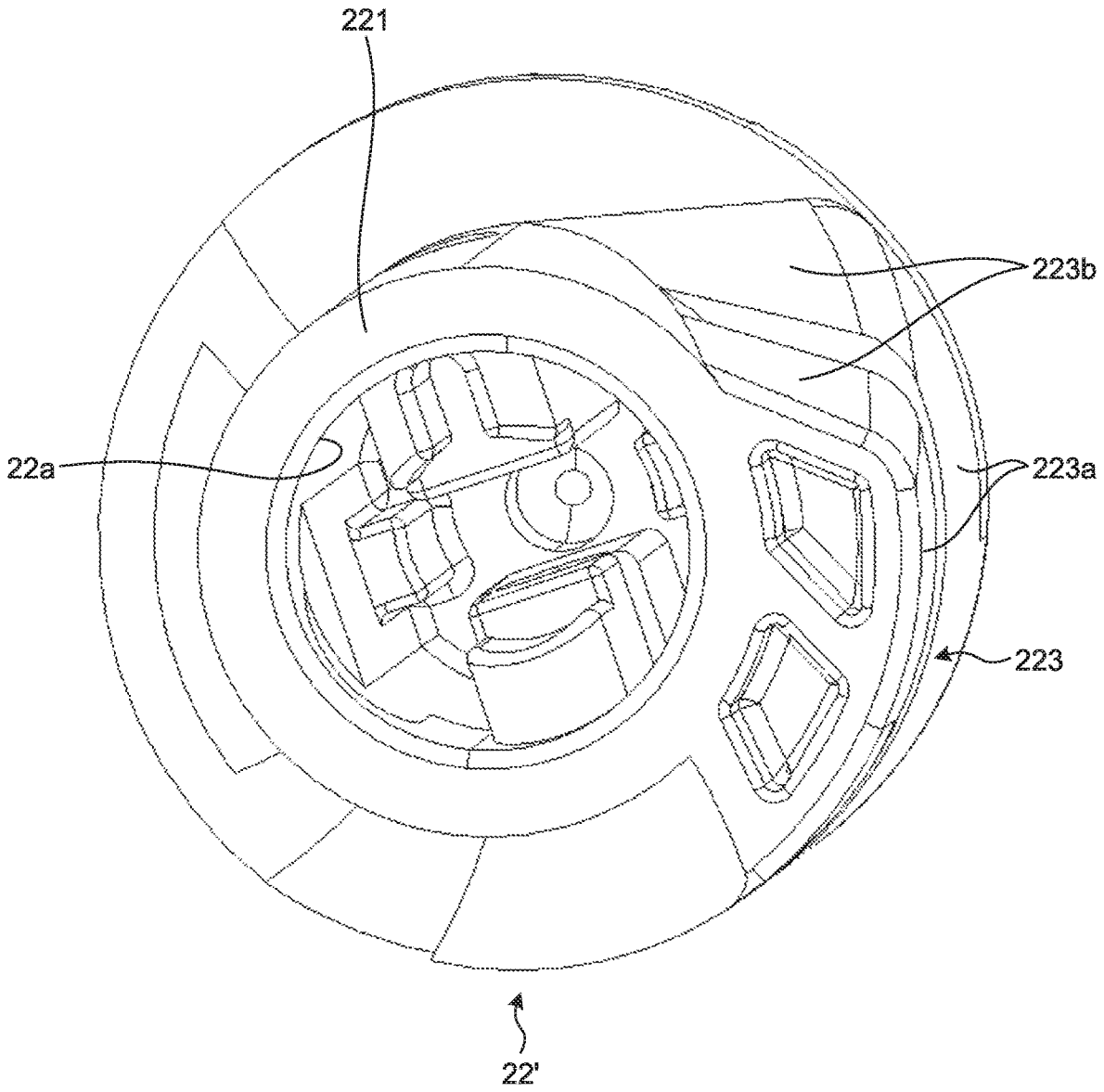
FIG. 18 is a perspective view illustrating the conveying base portion of FIG. 17.

Such a conveying base portion 22' includes the base end shaft 221 and an actuating portion 223 as illustrated in FIG. 18. The base end shaft 221 is a part that serves as the shaft 20*a* of the screw-type conveying member 20' together with the conveying shaft 21*a* of the conveying portion 21 in a configuration in which the conveying base portion 22' is engaged with the conveying portion 21, and extends along the front-and-back direction. This base end shaft 221 has the same outer diameter as the conveying shaft 21*a*.

The actuating portion 223 is provided on the outer circumferential surface of the base end shaft 221, in a manner protruding radially in a direction orthogonal to the longitudinal direction (front-and-back direction) of the base end shaft 221. This actuating portion 223 has an actuating outer circumferential surface 223*a* positioned radially more outwards than the blade portion 21*b*, and an actuating surface 223*b* that is curved and continuous to the actuating outer circumferential surface 223*a*.

Figure 19:
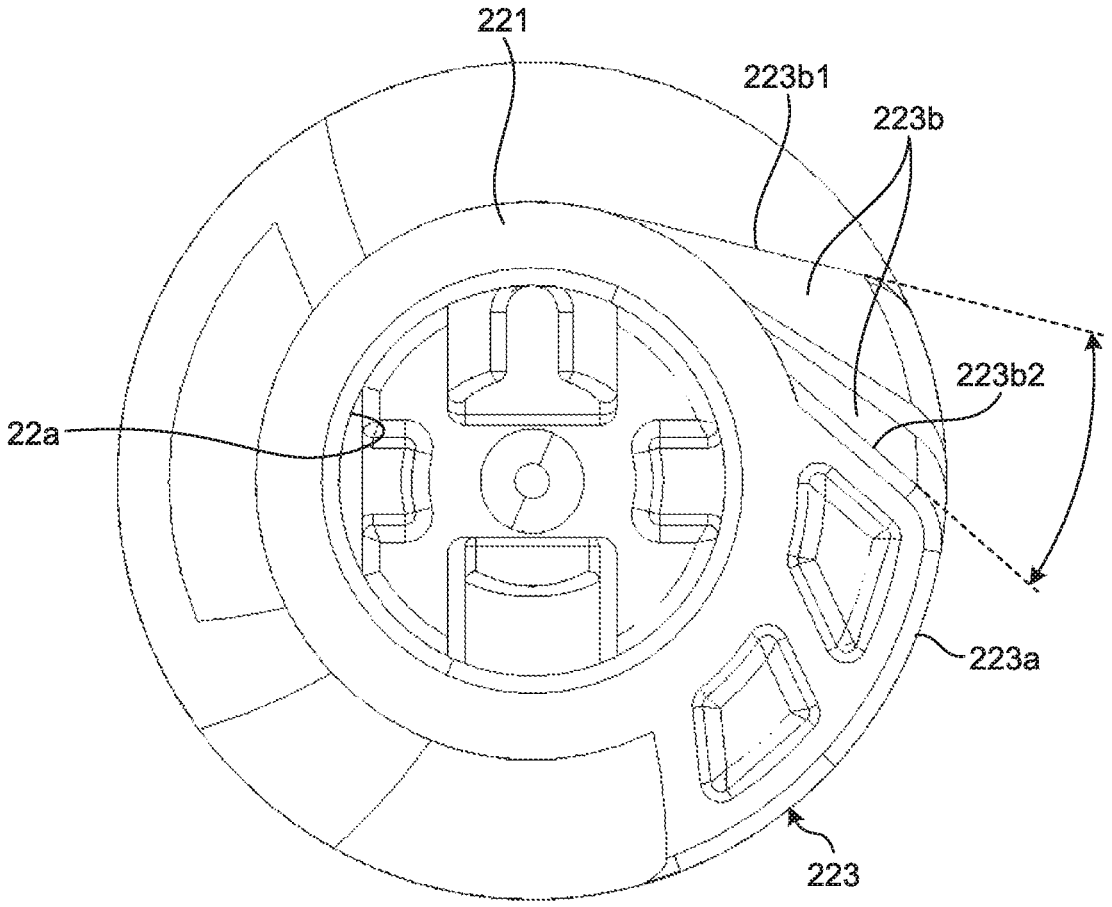
FIG. 19 is a front view illustrating the conveying base portion of FIG. 17.
Figure 20:
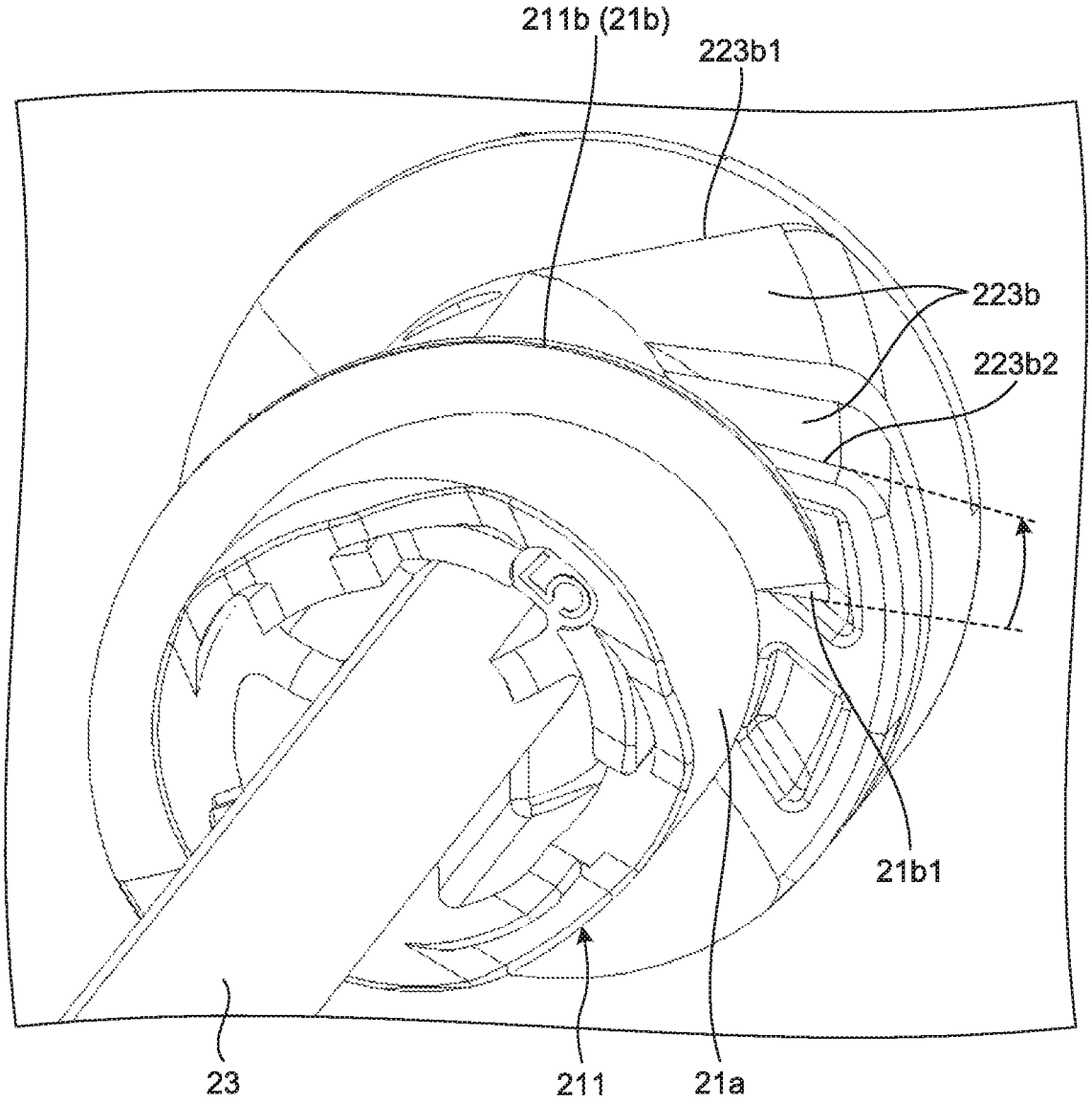
FIG. 20 is an enlarged perspective view illustrating a main part of the screw-type conveying member of FIG. 17.

Such an actuating surface 223*b* has a shape that is twisted more in one direction about the central axis of the base end shaft 221 (the shaft 20*a*) (e.g., in the counterclockwise direction in a view from the rear side) as the actuating surface 223*b* extends further toward the front side from a rear end 223*b*1 that includes a line tangent to the base end shaft 221 as illustrated in FIG. 19. The angle formed by the rear end 223*b*1 and a front end 223*b*2 of the actuating surface 223*b* is set to 25 degrees to 45 degrees, for example, in a view from the front side. The front end 223*b*2 is positioned in the other direction with respect to a rear end 21*b*1 of the blade portion 21*b* (the blade portion element 211*b*) about the central axis of the shaft 20*a* (e.g., in the clockwise direction in the view from the rear side) as illustrated in FIG. 20.

In the screw-type conveying member 20' including the engagement of the conveying portion 21 and the conveying base portion 22', the conveying base portion 22', that is the rear end, is connected to the motor 24 via a connecting unit (not illustrated). When the motor 24 is driven forwardly, the screw-type conveying member 20' is rotated in one direction (e.g., in the counterclockwise direction in a view from the rear side) about the central axis of the shaft 20*a* (the conveying shaft 21*a* and the base end shaft 221), and conveys the coins toward the front side. When the motor 24 is driven reversely, the screw-type conveying member 20' is rotated in the other direction (e.g., in the clockwise direction in the view from the rear side) about the central axis of the shaft 20*a*, and conveys the coins toward the rear side.

With such a configuration, when the screw-type conveying member 20' is rotated in the other direction (e.g., in the clockwise direction in the view from the rear side) about the central axis of the shaft 20*a*, the actuating surface 223*b* and the actuating outer circumferential surface 223*a* are brought into contact with the coins alternatingly, so that the actuating portion 223 can move the center of gravity of the coins accumulated on the actuating portion 223 up and down periodically.

In particular, when some of the coins become stored in the upright direction along one of the storage compartment guides 12, and a phenomenon what is called bridging, in which the coins are accumulated in a manner straddled between such coins and the other storage compartment guide 12, occurs, such bridging can be resolved by causing the actuating portion 223 to move the center of gravity of the coins up and down periodically. Therefore, it is possible to prevent jamming of the coins in the storage compartment 11.

Furthermore, the actuating surface 223*b* has a shape that is twisted more in the one direction about the central axis (e.g., in the counterclockwise direction in a view from the rear side) of the base end shaft 221 (shaft 20*a*) as the actuating surface 223*b* extends further toward the front side from the rear end 223*b*1 including a line tangent to the base end shaft 221. Therefore, it is possible to displace the coins to the front side, while moving the coins up and down, when the screw-type conveying member 20' is rotated in the other direction (e.g., in the clockwise direction in the view from the rear side) about the central axis of the shaft 20*a*. Hence, it is possible to prevent the coins from being caught by and locked onto the actuating surface 223*b*. This configuration also can prevent jamming of the coins in the storage compartment 11. Furthermore, because the front end 223*b*2 is positioned in the other direction (e.g., in the clockwise direction in the view from the rear side) with respect to the rear end 21*b*1 of the blade portion 21*b* (blade portion element 211*b*) about the central axis of the shaft 20*a*, the actuating surface 223*b* can be brought into contact with the coins more reliably than the blade portion 21*b* does, when the screw-type conveying member 20' is rotated in the other direction (e.g., in the clockwise direction in the view from the rear side) about the central axis of the shaft 20*a*.

A preferred embodiment of the present disclosure and a modification thereof are explained above, but the present disclosure is not limited thereto, and various modifications are still possible.

In the embodiment described above, the actuating portion 222 is configured to move the center of gravity of the coins accumulated on the actuating portion 222 up and down periodically as the screw-type conveying member 20 is rotated in the other direction about the central axis of the shaft 20*a*. However, according to the present disclosure, the actuating portion may be configured in any way as long as the actuating portion can move the center of gravity of the coins accumulated on the actuating portion up and down periodically as the screw-type conveying member is rotated about the central axis of the shaft.

In the embodiment described above, the actuating portion 222 includes the actuating outer circumferential surface 222*a* that is positioned radially more outwards than the blade portion 21*b*, and the actuating surface 222*b* that is a plane continuous to the actuating outer circumferential surface 222*a* and including a line tangent to the base end shaft 221 (shaft 20*a*). However, according to the present disclosure, the configuration of the actuating portion is not limited thereto, and any other configuration is included in the present disclosure as long as the actuating portion can move the center of gravity of the coins accumulated on the actuating portion up and down periodically as the screw-type conveying member is rotated about the central axis of the shaft.

In the embodiment described above, the reverse driving condition, satisfaction of which is determined by the driving determining unit 52, is explained to specify that the number of coins stored in the storage compartment 11 is equal to or greater than a predetermined number (threshold). However, according to the present disclosure, the reverse driving condition is not limited thereto, and the reverse driving condition may specify that the number of coins continuously supplied into the storage compartment is equal to or greater than a preset number.

According to the present disclosure, because the actuating portion provided to the screw-type conveying member moves the coins accumulated on the actuating portion up and down periodically as the screw-type conveying member is rotated about the central axis of the shaft, what is called "bridging" can be resolved. Therefore, it is possible to obtain an effect to prevent jamming of the coins in the storage compartments.

Although the disclosure has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A coin storage device comprising:

storage compartments that store therein coins by denomination; and screw-type conveying members, installed for the respective storage compartments, each of the screw-type conveying members including a shaft having an elongated shape and having an outer circumferential surface provided with a blade portion that protrudes radially outwards in a spiraling shape, and configured to convey coins toward a front side by being rotated in one direction about a central axis of the shaft, wherein each of the screw-type conveying members includes an actuating portion configured to move center of gravity of coins accumulated on the actuating portion up and down periodically as the screw-type conveying member is rotated about the central axis of the shaft.

2. The coin storage device according to claim 1, wherein the actuating portion is configured to move the center of gravity of the coins accumulated on the actuating portion up and down periodically as the screw-type conveying member is rotated in another direction about the central axis of the shaft.

3. The coin storage device according to claim 2, wherein the actuating portion is provided to an outer circumferential surface of the shaft in a manner protruding radially in directions orthogonal to a longitudinal direction of the shaft, and the actuating portion includes:

an actuating outer circumferential surface that is positioned radially more outwards than the blade portion; and an actuating surface that is planar and is continuous to the actuating outer circumferential surface.

4. The coin storage device according to claim 3, wherein the actuating surface is a plane including a line tangent to the shaft.

5. The coin storage device according to claim 2, wherein the actuating portion is provided to an outer circumferential surface of the shaft in a manner protruding radially in directions orthogonal to a longitudinal direction of the shaft, and the actuating portion includes:

an actuating outer circumferential surface that is positioned radially more outwards than the blade portion; and an actuating surface that is curved and is continuous to the actuating outer circumferential surface, and the actuating surface has a shape that is twisted more in the one direction as the actuating surface extends further toward the front side from a rear end that includes a line tangent to the shaft.

6. The coin storage device according to claim 5, wherein the actuating surface has a shape in which a front end of the actuating surface is positioned in the other direction with respect to a rear end of the blade portion.

7. The coin storage device according to claim 1, wherein the actuating portion is provided to a rear end of the shaft.

8. The coin storage device according to claim 1, further comprising:

auxiliary screw members, installed in a manner meshed with the blade portion on both sides of the screw-type conveying member in the storage compartment, configured to rotate about respective central axes thereof, as the screw-type conveying member is rotated about the central axis of the shaft, by being driven by the rotation of the screw-type conveying member.

9. The coin storage device according to claim 8, wherein each of the auxiliary screw members is provided with a restricting guide that restricts the auxiliary screw member from being unmeshed from the screw-type conveying member, and the restricting guide for one of the auxiliary screw members is disposed at a position facing where the restricting guide for another auxiliary screw member is not provided.

* * * * *